United States Patent [19]

Bell

[11] 3,955,747

[45] May 11, 1976

[54] CONTAINER WITH TOP-LIFTING FLANGE

[75] Inventor: John T. Bell, St. Charles, Ill.

[73] Assignee: Container Corporation of America, Chicago, Ill.

[22] Filed: July 30, 1975

[21] Appl. No.: 600,354

[52] U.S. Cl. ..... 229/37 E
[51] Int. Cl.[2] ..... B65D 5/02
[58] Field of Search ..... 229/37 R, 37 E, 17 B

[56] References Cited

UNITED STATES PATENTS

| | | | |
|---|---|---|---|
| 1,146,115 | 7/1915 | Weiss | 229/37 E |
| 1,639,793 | 8/1927 | Beyer | 229/37 E UX |
| 2,474,523 | 6/1949 | Guyer | 229/37 E |
| 2,752,032 | 6/1956 | Fish | 229/37 E X |
| 2,990,996 | 7/1961 | Bebout | 229/37 E |
| 3,369,652 | 2/1968 | Debout | 229/37 E X |
| 3,606,969 | 9/1971 | Voytko | 229/17 B |

*Primary Examiner*—Davis T. Moorhead
*Attorney, Agent, or Firm*—Carpenter & Ostis

[57] ABSTRACT

A shipping container having an integral flange arrangement adjacent the upper end thereof for facilitating the lifting of the container by the vertically disposed blades of a lift truck.

1 Claim, 3 Drawing Figures

CONTAINER WITH TOP-LIFTING FLANGE

SUMMARY OF THE INVENTION

The invention relates to shipping containers adapted to be lifted by a lift truck having vertically extending blades which engage outer flanges at the upper end of the container.

This method of lifting heavy-duty shipping containers of the type used to enclose large articles such as washing machines, dryers, refrigerators, etc., has many advantages over conventional means of lifting. For example, it does not require as much warehouse space as when a lift truck fork is slipped under a container. Also, it minimizes chances of the packaged article being damaged by the side clamps of a lift truck.

It is believed that the invention disclosed herein represents an advantage over the arrangement disclosed in U.S. Pat. No. 2,990,996, because in the container of the present invention the lifting flanges are an integral part of the container and do not require external straps, as required in the patented structure. Strapping material and the additional equipment and labor required for the strapping operation increases the overall cost of the packaging operation.

It is therefore an object of this invention to provide a heavy-duty container with an integral top-lifting flange arrangement which is integral and does not require the use of external strapping.

This and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

Figure 1:
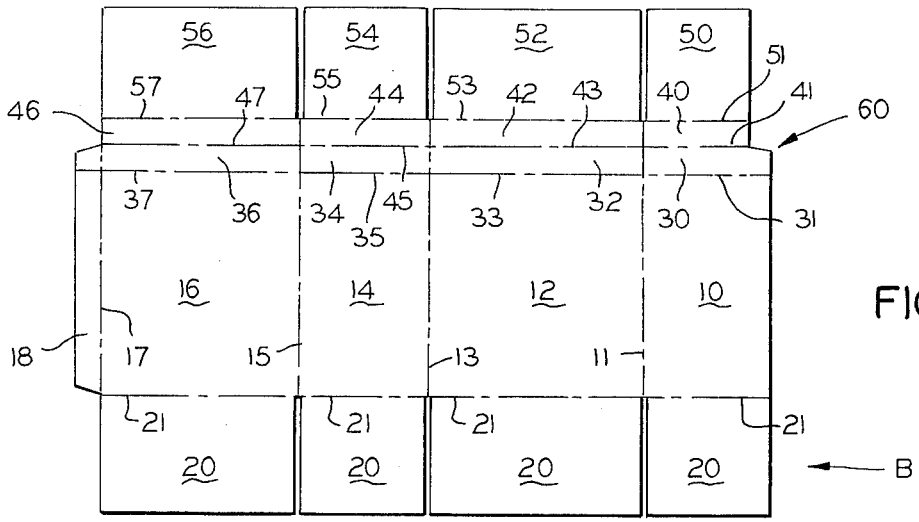
FIG. 1 is a plan view of the blank of sheet material from which the container illustrated in the other views may be formed.
Figure 2:
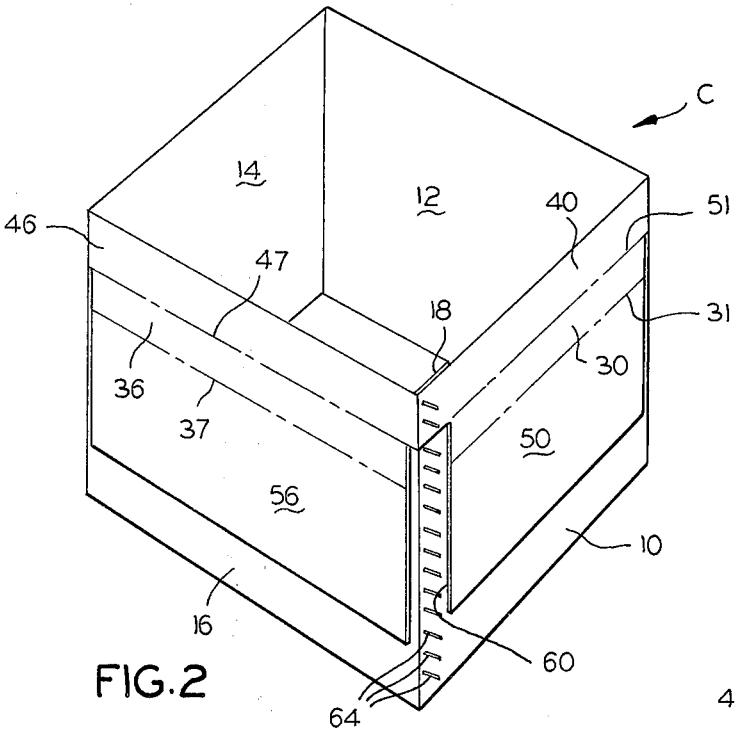
FIG. 2 is a perspective view of a shipping container embodying features of the invention, shown with the container in an open position ready for loading.

Referring now to the drawings, it will be seen that a container indicated generally at C embodying features of the invention is illustrated in FIG. 2. The container may be formed from a unitary blank of sheet material such as corrugated paperboard indicated generally at B and illustrated in FIG. 1 of the drawings.

As best seen in FIG. 1, the main portion or body of the container includes a plurality of side wall panels 10, 12, 14, and 16, and retaining flap 18 which are serially joined to each other along fold lines 11, 13, 15, and 17, respectively.

At the bottom of the structure, there are provided a plurality of bottom closure flaps 20 which are foldably connected to their related side wall panels along coextensive fold lines 21. To close the bottom of the container, the closure flaps may be folded and secured to each other in overlapping relationship in a conventional manner.

At its upper end, the container is provided with a plurality of closure flaps 50, 52, 54, and 56, which are foldably connected to side wall panels 10, 12, 14, and 16, respectively, by a plurality of flange members hereinafter described in detail. Foldably connected to the upper edges of side wall panels 10, 12, 14, and 16, along fold lines 31, 33, 35, and 37, are a plurality of inner flange elements 30, 32, 34, and 36, respectively.

Foldably connected to inner flange elements 30, 32, 34, and 36, along fold lines 41, 43, 45, and 47, are a plurality of outer flange elements 40, 42, 44, and 46, respectively, which are in turn foldably connected to top closure flaps 50, 52, 54, and 56 along fold lines 51, 53, 55, and 57, respectively.

Still referring to FIG. 1, it will be seen that retaining flap 18 extends above the upper edge of fourth side wall panel 16, so that it is also foldably connected to inner flange element 36 along an extension of fold line 17. Again, still referring to FIG. 1, it will be seen that edge portions of outer flange element 40 and top closure flap 50, which are associated with side wall panel 10, have been cut away for a purpose hereinafter described.

Figure 3:
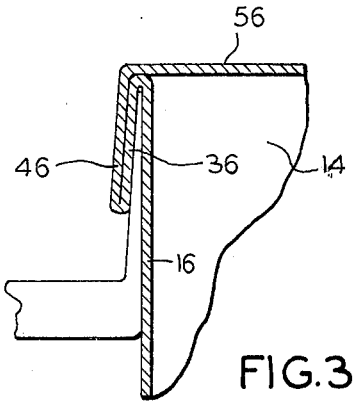
FIG. 3 is a fragmentary, vertical section of an upper corner of the container illustrated in FIG. 2, with the top closure flaps shown in a closed position.

The purpose of the invention described herein is to provide a container with a top-lifting flange which may be easily formed and which does not require any external securing means, such as straps or bands. This is accomplished by the recess 60 in the outer flange element 40 and top closure flap 50. When the container is formed, before the ends are closed, retaining flap 18 is disposed to overlie a marginal portion of first side wall panel 10. The top closure flaps and flange elements are folded downwardly 180°, as seen in FIG. 2, and because of the recess 60, that part of the marginal portion of side wall panel 10 which is below inner flange 30 is exposed. This makes it possible to stitch as at 64 the retaining flap 18 to side wall panel 10, and also, to inner flange element 30 at the same time. After this has been done, the container may be shipped to the customer in a collapsed condition with both ends open. The upper end of the container may be closed by first folding the outer flange elements and top closure flaps upwardly 180°, so that the outer flange elements are in face-to-face relationship with their related inner flange elements. Next the top closure flaps are folded inwardly another 90° and secured to each other in a conventional manner. The bottom closure flaps may be folded and closed in a conventional manner. After the carton is closed, the inner flange elements are secured in position and the space between the inner flange elements and the side wall panels provides an area for receiving vertically extending blades of a lift truck, as best seen in FIG. 3.

Thus, it will be understood that the novel structure provides a top-lifting flange arrangement which requires no external securing means, because one inner flange element is secured to the body of the container at the same time that the manufacturer's joint is formed and the top closure flaps are held open for loading of the container.

Additionally, the inner flange elements are secured in place by the same stitching operation that is used to form the manufacturer's joint, i.e. securing flap 18 to the marginal portion of the side wall panel 10, so that it is not necessary to stitch the flanges around the entire periphery of the container, as required by other prior art structures.

I claim:

1. In a collapsible shipping container, formed of a unitary blank of paperboard, having a top-lifting flange arrangement for engagement by vertically extending blades of a lift truck, the combination of:

a. first, second, third, and fourth side wall panels serially joined to each other at their side edges;

b. a relatively narrow, elongated retaining flap foldably connected to said fourth side wall panel and disposed to overlie a marginal portion of said first side wall panel to form a tubular structure;

c. bottom closure flaps foldably connected to the lower ends of said side wall panels and securable to each other in overlapped relation for closing the lower end of said tubular structure;

d. top closure flaps securable to each other in overlapped relation for closing the upper end of said tubular structure;

e. a plurality of flange members foldably connecting each of said top closure flaps to a related side wall panel;

f. each of said flange members including:

i. an inner flange element foldably connected at its upper edge to the upper edge of a related side wall panel and being folded outwardly and downwardly 180° to lie in full-face engagement with the outer surface of said related side wall panel;

ii. an outer flange element foldably connected at its lower edge to the lower edge of said first element, foldably connected at its upper edge to an edge of a related top closure flap, and being folded upwardly 180° to lie in full-face engagement with the outer surface of said inner flange element;

g. the outer flange element and the top closure flap which are related to said first side wall panel being recessed at one side thereof to expose the part of said marginal portion of said first side wall panel which is below the related inner flange element;

h. said retaining flap being secured to said marginal portion of said first side wall panel and to the related inner flange element.

* * * * *